US005295427A

United States Patent [19]

Johnsen et al.

[11] Patent Number: 5,295,427

[45] Date of Patent: Mar. 22, 1994

[54] BRIDGE FOR STRING INSTRUMENTS

[76] Inventors: Jens Johnsen, Tarpenbekstrasse 48,, D-2000 Hamburg 20, Fed. Rep. of Germany;

[21] Appl. No.: 7,321

[22] Filed: Jan. 21, 1993

[30] Foreign Application Priority Data

Jan. 21, 1992 [DE] Fed. Rep. of Germany ..... 4201438

[51] Int. Cl.[5] ..... G10D 3/04

[52] U.S. Cl. ..... 84/307

[58] Field of Search ..... 84/297 R, 298, 299, 84/306, 307, 308, 309

[56] References Cited

U.S. PATENT DOCUMENTS 2,573,254 10/1951 Fender ..... 84/306
2,737,842 3/1956 Polfuss ..... 84/299
5,171,927 12/1992 Kubicki et al. ..... 84/306 X

*Primary Examiner*—Michael L. Gellner

*Assistant Examiner*—Patrick J. Stanzione

*Attorney, Agent, or Firm*—Feiereisen & Kueffner

[57] ABSTRACT

A bridge for string instruments, particularly for guitars, including base guitars, serves for adjustably fastening the strings of the instrument to the instrument body. The bridge has a base body and a bearing cylinder for each string. The bearing cylinder extends perpendicularly to the string axis and is rotatably mounted for adjusting the height of the string. Each bearing cylinder has a string throughbore extending perpendicularly to the cylinder axis and in alignment with a throughbore in the base body. An intonation tube, through which the corresponding string extends, is provided in each string throughbore, so as to be adjustable in axial direction of the intonation tube. An adjustment of the intonation tube in axial direction of the string throughbore results in an adjustment of the length of the string. A rotation of the bearing cylinder results in an adjustment of the height of the string.

8 Claims, 2 Drawing Sheets

BRIDGE FOR STRING INSTRUMENTS

BACKGROUND OF THE INVENTION

1. Field of the Invention

The present invention relates to a bridge for stringed instruments, particularly guitars, including bass guitars. The bridge extends transversely to the strings and serves for the adjustable fastening of the strings to the instrument body. The bridge includes a base member and an adjusting mechanism.

2. Description of the Related Art

Bridges of the above-described type are known in the art in various configurations. They are attached to the instrument body, i.e., to the belly or table of the resonance body, or to a solid body, and serve to transmit the vibrations of the strings to the body. The bridge is used for the vertical adjustment of the string relative to the belly and for the longitudinal adjustment, i.e., to adjust a more or less strong tension of the string.

However, the transmission of the vibration of the strings to the instrument body is frequently not satisfactory when known bridges are used.

SUMMARY OF THE INVENTION

Therefore, it is the primary object of the present invention to provide a bridge of the above-described type which substantially improves the transmission of the string vibration, in order to improve the sound and simulataneously to prevent the danger of injury and any possible dirt deposits.

In accordance with the present invention, the solid base body of the bridge has, for each string, a bearing cylinder, wherein the axis of the cylinder extends perpendicularly to the string axis. The bearing cylinder is rotatable within the base body for carrying out the vertical adjustment of the string. Each bearing cylinder has a string throughbore which extends perpendicularly to the cylinder axis. The base body also has a throughbore which is in alignment with the string throughbore of the cylinder.

An intonation tube, through which the corresponding string extends, is mounted in the string throughbore, so as to be adjustable in longitudinal direction of the string throughbore in order to adjust the length of the string.

Accordingly, in accordance with the present invention, the vertical adjustment of the string is carried out by rotating the bearing cylinder. The adjustment of the tension of the string is effected by adjusting the intonation tube. In accordance with a preferred feature, each intonation tube is fastened in the respective string throughbore by means of a threaded connection, so that the tension of the string can be adjusted by screwing the intonation tube into the bearing cylinder or out of the bearing cylinder by a certain extent.

Due to the fact that the intonation tube has, because of its shape, an elongated bore in the direction of the string, a large contact surface area is available for the string at the points where the string enters and exits the intonation tube. Thus, a continuous increase of the inert mass is obtained from the first contact point of the string with the intonation tube, where the string enters the intonation tube in the direction toward the instrument body.

The solid construction of the base body of the bridge leads to a good pick-up of axial, vertical, and horizontal vibrations. The manner in which the string extends through the intonation tube to the end point of the string at the base body results in an essentially three-dimensional string suspension which picks up and transmits in each direction of vibration in an optimum manner.

In summary, the bridge according to the present invention provides a better transmission of the string vibrations to the resonance body, while simultaneously increasing and extending the sustaining period of the string. Moreover, the adjustment of the height of the string and of the tension thereof can be effected in a simple and reproducible manner. The construction of the bridge is clean and counteracts the danger of any injury or contamination.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there is illustrated and described a preferred embodiment of the invention.

DESCRIPTION OF THE PREFERRED EMBODIMENT

Figure 1:
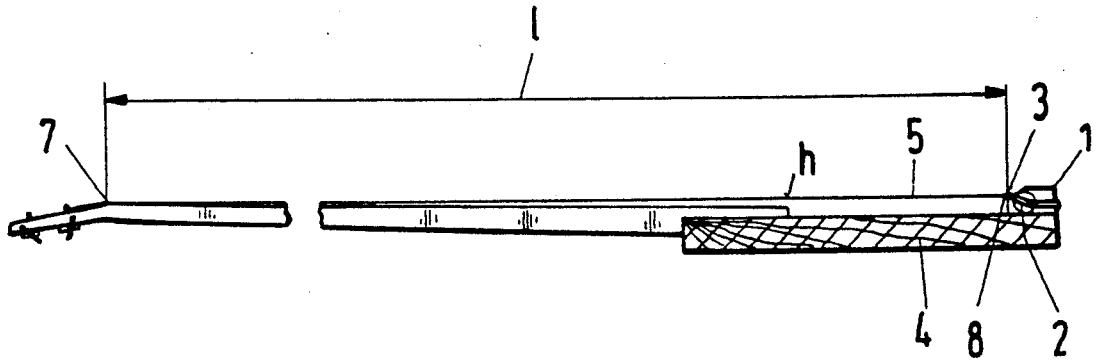
FIG. 1 is a schematic side view of a guitar with a bridge in accordance with the present invention.

FIG. 1 of the drawing shows a guitar with a guitar body 4 and a neck with a head attached to the guitar body 4. The strings 5 are tensioned between the head and the bridge.

The bridge includes a base body 1. The bridge also includes an adjusting mechanism for adjusting the measure of the string, i.e., for adjusting the string in longitudinal direction 1 and for adjusting the height h. Each string 5, only one of which is shown in the drawing, is fastened to the base body 1 at 11. The end point of the string is denoted by reference numeral 9.

Figure 2:
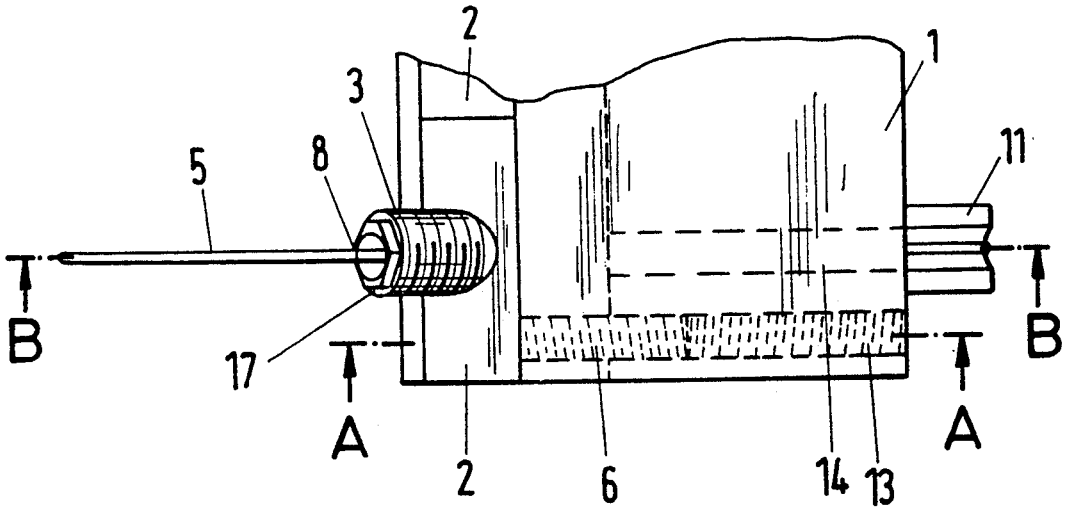
FIG. 2 is a partial top view, on a larger scale, showing the connection of only one of the strings.

The actual adjusting mechanism is provided at the other end of the base body, i.e., at the end which faces the head of the guitar. The adjusting mechanism includes a bearing cylinder 2 for each string 5. The bearing cylinder 2 is rotatably mounted in the base body 1. As can be seen in FIG. 2, the bearing cylinders are arranged next to each other, and the axes of the cylinders extend perpendicularly to the axes of the strings.

Each bearing cylinder 2, which is rotatable about the cylinder axis, has a string throughbore 15. The string throughbore 15 is provided with a thread and receives an intonation tube 3, which is provided with a corresponding external thread, so that the intonation tube 3 is adjustable by turning the intonation tube.

Figure 3:
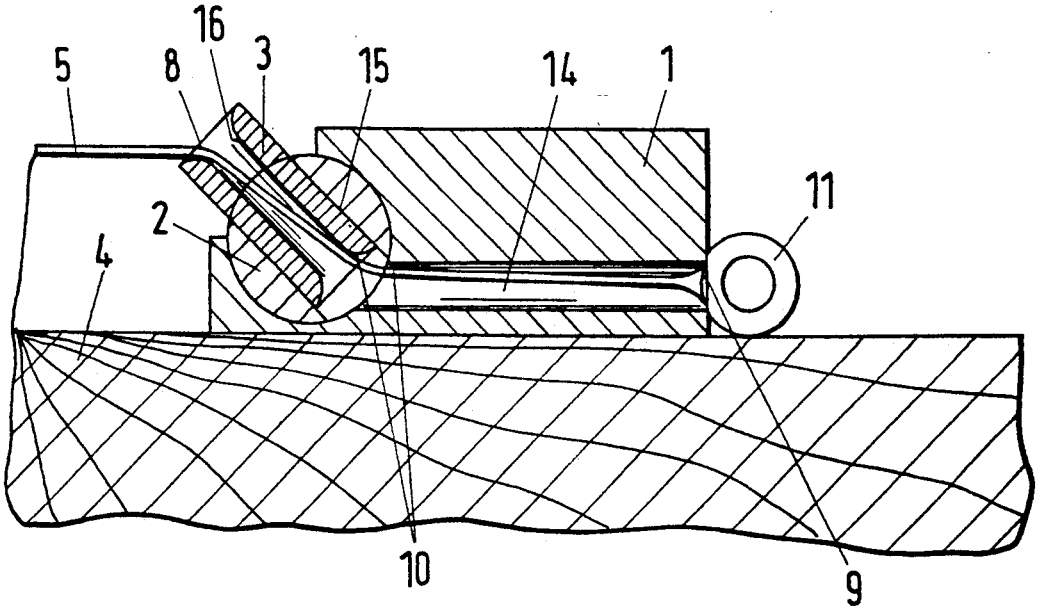
FIG. 3 is a sectional view taken along sectional line III—III of FIG. 2.
Figure 4:
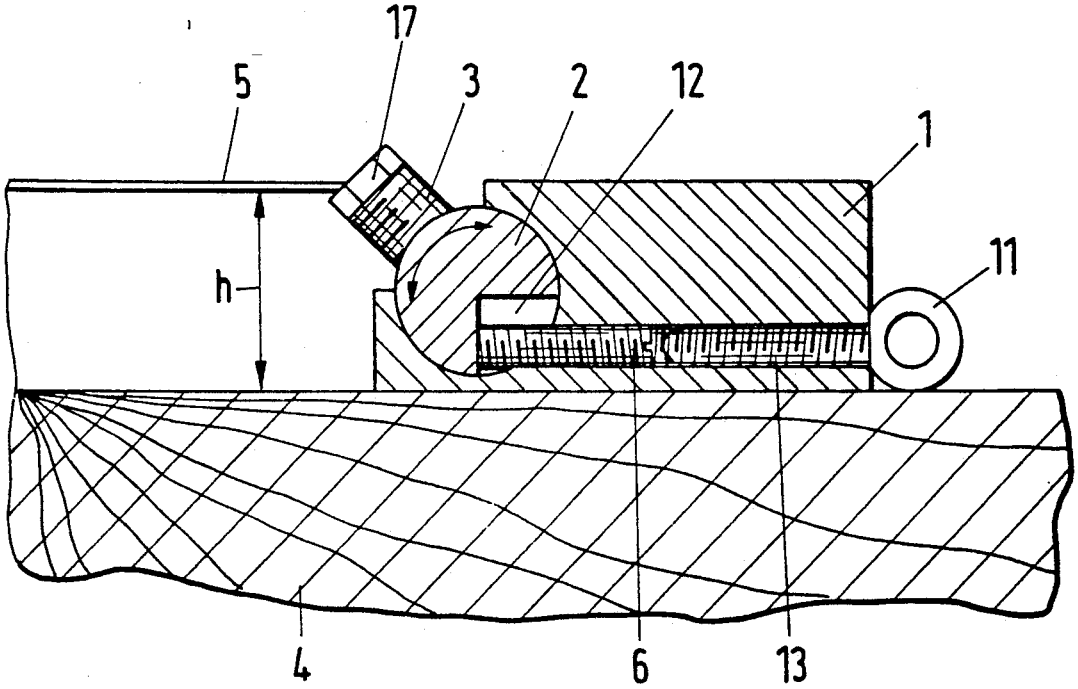
FIG. 4 is a sectional view taken along sectional line IV—IV of FIG. 2.

As can be seen in FIG. 3, the string 5 extends through the bore of the intonation tube 3 and, thus, through the string throughbore 15 and through a throughbore 14 in the base body 1, which is in alignment with the string throughbore 15, and the string ends at 9, secured by member 11.

The outer end of the intonation tube 3 has a portion 17 adapted to be engaged by a tool.

A threaded bore 13, which extends parallel to but laterally offset from the throughbore 14, is provided in the base body 1. A headless screw 6 is screwed into the threaded bore 13. At the end remote from the end provided with a slot for adjusting the headless screw, the headless screw engages in a recess 12 of the bearing cylinder 2. By turning the headless screw 6, the bearing cylinder can be rotated about its axis, so that the outer end of the intonation tube 3 is swung up and down. This rotation effects the adjustment of the height h.

The adjustment of the measure, i.e., the adjustment of the length l, is effected by means of a tool acting on the portion 17 of the intonation tube 3, so that the intonation tube 3 is turned, and the intonation tube 3 is screwed into or out of the threaded bore 15 to a certain extent.

The intonation tube 3 has a bore 16. The string 5 extends through this bore 16 and rests at 8 and 10 against the corresponding parts of the bridge and, thus, ensures a good transfer of the vibrations to the bridge and, consequently, to the guitar body 4.

Accordingly, the height and the length of each string is individually adjustable. The height adjustment is effected by means of the headless screw 6 in the threaded bore 13, and the length adjustment is effected by screwing the intonation tube 3 into or out of the bearing cylinder 2.

The drawing further shows that the base body 1 is of compact construction and has a height which is greater than half the diameter of the bearing cylinders 2 which are mounted next to each other. The bearing cylinders 2, in turn, have a greater diameter than the individual intonation tubes 3. The base body 1 is made of a metal having high density, for example, a brass/bronze alloy, i.e., a copper-based alloy.

The distance h of the string to the body or the finger board of the guitar is practically adjusted by turning the headless screw 6. The length 1 of the string between the contact points 7 and 8, as seen in FIG. 1, is adjusted by turning back and forth the screw-like intonation tube 3.

It should be understood that the preferred embodiment and examples described are for illustrative purposes only and are not to be construed as limiting the scope of the present invention which is properly delineated only in the appended claims.

I claim:

1. A bridge for stringed instruments for fastening the strings of the instrument to a body of the instrument, the bridge comprising a solid base body, a bearing cylinder for each string mounted in the base body, the bearing cylinder being rotatable for effecting a vertical adjustment of the string relative to the instrument body, the bearing cylinder having an axis extending perpendicularly to a string axis, the bearing cylinder defining a string throughbore having an axis and extending perpendicularly to the bearing cylinder axis, the base body defining a throughbore positioned in the base body, the throughbore being in alignment with the string throughbore of the bearing cylinder, an intonation tube mounted in the string throughbore, the intonation tube being adjustable in axial direction of the string throughbore, the string extending through the intonation tube, such that a length adjustment of the string is effected by an adjustment of the intonation tube in axial direction of the string throughbore of the bearing cylinder.

2. The bridge according to claim 1, wherein the base body defines a threaded bore for each bearing cylinder, a headless screw being mounted in the threaded bore in engagement with the bearing cylinder for effecting the rotation of the bearing cylinder.

3. The bridge according to claim 2, wherein the headless screw engages in a recess of the bearing cylinder.

4. The bridge according to claim 3, wherein the recess is located offset relative to the string throughbore in the direction of the bearing cylinder axis, and wherein the threaded bore and the throughbore of the base body extend parallel to each other.

5. The bridge according to claim 1, wherein the string throughbore has a thread, and the intonation tube has an external thread, the intonation tube being fastened by means of the external thread in the thread of the string throughbore, and wherein the intonation tube comprises means adapted for the engagement of a tool for turning the intonation tube.

6. The bridge according to claim 1, wherein the base body has a height above the instrument body, and wherein the bearing cylinder and the intonation tube each have a diameter, the height of the base body being greater than half the diameter of the bearing cylinder and the diameter of the bearing cylinder being greater than the diameter of the intonation tube.

7. The bridge according to claim 1, wherein the solid base body is of a metal having a high density.

8. The bridge according to claim 8, wherein the metal of high density is a copper-based alloy.

* * * * *